United States Patent [19]

Rogers

[11] 4,012,032

[45] Mar. 15, 1977

[54] DOCUMENT REPRODUCTION HAVING OUTPUT MEANS WITH PLURAL OUTPUTS OPERABLE IN A PLURALITY OF MODES

[75] Inventor: James Charles Rogers, Wyckoff, N.J.

[73] Assignee: International Business Machines Corporation, Armonk, N.Y.

[22] Filed: Nov. 28, 1975

[21] Appl. No.: 636,250

[52] U.S. Cl. ..... 271/64; 271/173; 271/259

[51] Int. Cl.[2] ..... B65H 29/60

[58] Field of Search ..... 271/64, 173, 258, 259; 270/58

[56] References Cited

UNITED STATES PATENTS

| | | | |
|---|---|---|---|
| 3,229,599 | 1/1966 | Lowe | 271/173 X |
| 3,744,790 | 7/1973 | Hoffman | 271/173 |
| 3,845,949 | 11/1974 | Acquaviva et al. | 271/64 |

*Primary Examiner*—Robert W. Saifer
*Attorney, Agent, or Firm*—Herbert F. Somermeyer

[57] ABSTRACT

A document reproduction machine, such as a convenience copier, has an operator selected noncollated tray output and a collated output. To ensure that reproduction of documents does not stop when either the capacity of the tray or the collator is exceeded, automatic control means switch document transport from the tray to the collator for filling up the collator in a noncollating mode, and vice versa.

5 Claims, 2 Drawing Figures

DOCUMENT REPRODUCTION HAVING OUTPUT MEANS WITH PLURAL OUTPUTS OPERABLE IN A PLURALITY OF MODES

BACKGROUND OF THE INVENTION

This invention relates to a document reproduction method and apparatus including automatic control means for preventing overfeeding of copies to either a noncollating or a collating output portion.

In document reproduction machines having a high-speed copy reproduction portion and a document output portion, the reproduction portion usually can reproduce more documents than can be stored in either a noncollate output tray or a collate output portion. Many of these machines are sufficiently fast in document reproduction that operator control is ineffective to prevent a paper jam, i.e., the document reproduction portion may supply more documents than can be handled by either the collator or the tray. This is particularly true where documents are automatically transported from the document reproduction portions to either a noncollate tray or to a collator.

SUMMARY OF THE INVENTION

It is an object of the invention to provide a document reproduction machine having a multi-mode output which is automatically switchable to accommodate a maximum number of documents being reproduced irrespective of operator selection or intervention.

In one embodiment of the invention, a document reproduction machine operating in a noncollate mode supplies all reproduced documents to a noncollating output tray. This tray has a limited capacity. Automatic control means senses when the tray is filled. The machine then automatically directs documents being received from the document reproduction portion to an automatic collator. Under direction of the automatic control means, the collator then fills each of the collator bins beginning at one end of the collator and proceeds towards the other end until all copies have been received from the document reproduction portion.

The machine described above, when operating in the collate mode, provides overflow copies to the noncollate tray. If the collator has 20 collate bins and 25 collated copy sets are to be reproduced, the excess five copies per sheet of the original are directed to the noncollate tray. Therefore, in page 1 of the document being reproduced, 20 page 1's are received by the collator bins and five copies of page 1 are received by the noncollate tray. This action is repeated for page 2 of the original and so forth.

Using the above-described two principles in combination, a document run is completed even though the number of copies exceeds the individual capacities of the various output portions of the document reproduction machine.

The foregoing and other objects, features, and advantages of the invention will be apparent from the following more particular description of a preferred embodiment of the invention, as illustrated in the accompanying drawing.

THE DRAWING

DETAILED DESCRIPTION OF THE INVENTION

Figure 1:
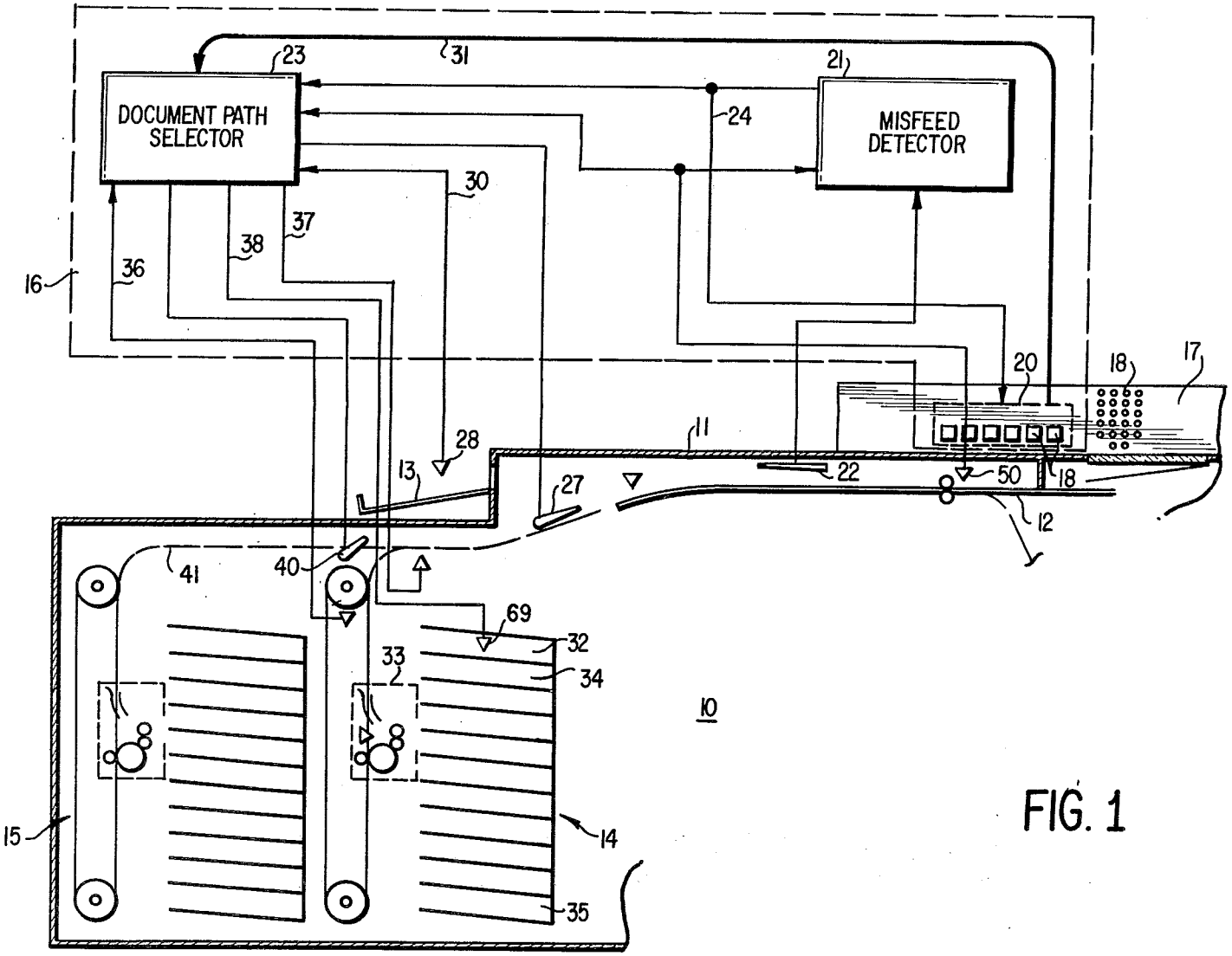
FIG. 1 is a partial and simplified diagrammatic elevational view of a document reproduction machine incorporating the teachings of the invention and including a simplified block diagram of an automatic control means.

Referring now more particularly to the drawings, like numerals indicate like parts and structural features in the diagrams. A document reproduction machine includes an electrostatic reproduction portion 10, such as shown in U.S. Pat. No. 3,834,807. Document reproduction portion 10 supplies reproduced documents to a document transporting portion 11 which transports received documents from a transfer point 12 (the exit portion of reproduction portion 10) to noncollate output tray 13, first collator 14, or second collator 15. If the document reproduction portion 10 is operable in a duplex mode, i.e., can copy on both sides of the paper, a duplexing station (not shown) is included in the document reproduction portion. An automatic control means 16 controls the operation of the document reproduction portion 10, document transport portion 11, and collators 14 and 15. Conveniently located on document reproduction portion 10 is an operator control panel 17 having a plurality of function selection switches 18 which, inter alia, select collate or noncollate modes, paper size, number of copies, and the like. Electronic control circuits, which may include a programmable microprocessor, are installed adjacent panel 17 as indicated by dashed line box 20. This portion of the control is peculiar to the operation of document reproduction portion 10 and is not further described for that reason, the cited reference indicating the type of control functions that are necessary to be performed in connection with constructing and using an electrostatic document reproduction portion 10.

Also included in the automatic control means is misfeed detector 21 responsive to a plurality of sensors represented by line 22. A misfeed signal results from a document jam in the document transport portion 11, copier 10 document transport portion (not shown), or in the operation of collators 14 and 15. Upon detection of improper document transport, misfeed detector 21 supplies a stop (misfeed) signal over line 24 to copier control 20 for turning the machine off and to document path selector 23 for limiting or stopping document transporting in collators 14 and 15. Since misfeed detectors, such as detector 21, are well known in the art, that portion of the automatic control means is not further described.

When the operator selects a noncollate mode via control panel 17, document transport portion 11 actuates document deflecting gate 27 to a downward up-deflecting position whereby documents received via portion 11 are inserted into noncollate output tray 13. A tray-full sensing switch 28 senses when tray 13 has reached its document holding capacity. Switch 28 then closes to supply a tray-full signal over line 30 to document path selector 23. Selector 23 responds to the tray-full signal and to a noncollate mode indication from panel 17 received over cable 31 to activate first collator 14 and then move gate 27 to the illustrated upward document down-deflecting position directing subsequently received documents downwardly to collator 14. Collator 14 responds by first filling its upwardmost collate document-receiving bin 32, and then stepping the sorting carriage 33 downwardly to the second bin 34, and so forth, through bin 20, until the first collator 14 is filled. Assuming that each collator 14 bin can receive 75 copies, 1,500 copies can be inserted in the collator 14 in a noncollate mode. When collator 14 has moved its sorting carriage 33 to the bottommost position and the bottommost bin 35 has been filled, the full condition of collator 14 is supplied to document path selector 23 over lines 36, 37, and 38, as will be hereinafter more fully described. At this time, document path selector 23 adjusts document deflection gate 40 from the illustrated upward position wherein documents are deflected downwardly to collator 14 to a downward position wherein documents received from gate 27 are deflected upwardly to document path 41 for entry and collation into second collator 15. Operation of the two collators is identical. When the second collator 15 has filled all of its document-receiving bins and its sorting carriage has reached its lowermost position, a full signal is supplied by document path selector 23 to the operator panel 17 and the document reproduction machine is turned off.

In the collate mode, sensing switch 69 senses when bin 32 is full. Switch 69 then sends a signal to automatic control 16 indicating that after the set of copies being received are in the collators 14 and 15, the collators are full. Document reproduction portion 10 responds by stopping after the last copy of the set has been reproduced and deposited in the appropriate collator bin. The operator then removes the collated copies and restarts the machine to continue collated reproduction.

NONCOLLATE MODE

Overflow from tray 13 to collators 14, 15 is controlled by counter 75. Collators 14 and 15 are operated in a stacker mode, i.e., bin 32 is first filled, then bin 34, etc. Since the total copy capacity of tray 13 and collators 14 and 15 exceeds the modules of the copy selection of control 20, the collator bins need not be filled to their actual capacity while accommodating substantial overflow from tray 13. This selection enhances operational reliability of the entire machine. That is, when a collator bin is filled to its actual capacity, the probability for a misfeed at the bin increases. When the number of copies to be deposited in one bin is limited to a number less than actual capacity, the probability of a misfeed is greatly reduced. Accordingly, the number of copies placed in a collator bin in a noncollate overflow operation is selected to be less than the maximum capacity in accordance with an expected maximal run size (number of copies). In one constructed embodiment, this number was selected to be fifty, then the bin is "full".

Figure 2:
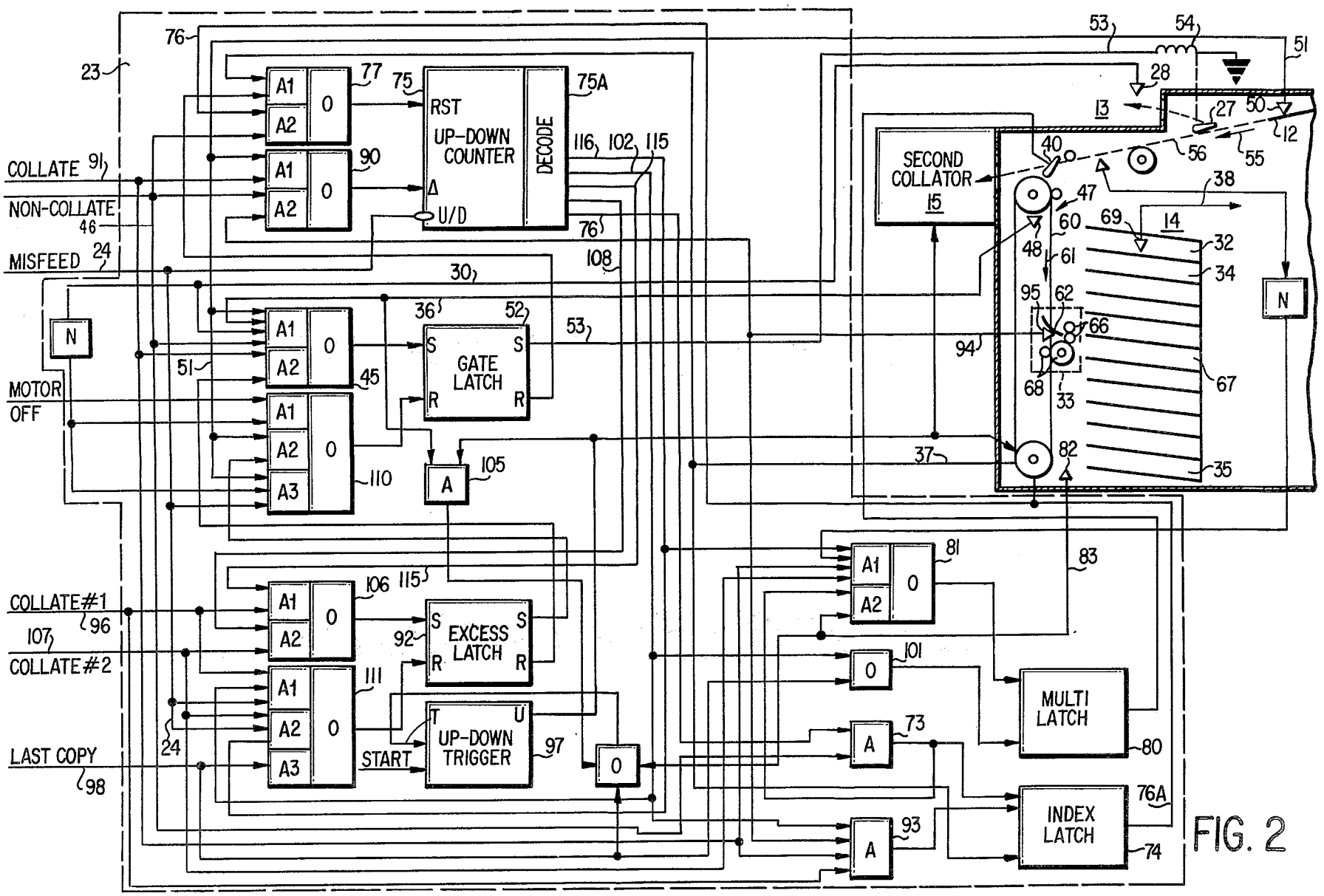
FIG. 2 is a combined diagrammatic and schematic diagram of the FIG. 1 illustrated machine for showing the automatic control means which directs reproduced documents to designated output portions.

The description starts assuming that document reproducing portion 10 has been placed in the noncollate mode via operator panel 17. Reproduced documents exit portion 10 and 12 and are transported through document transport portion 11, and deflected by gate 27 into noncollate document receiving tray 13. Switch 28 continuously senses whether or not tray 13 is full. When full, switch 28 supplies a tray-full signal over line 30 to the Al (AND) input part in AO circuit 45 (AO means AND-OR) of document path selector 23. The other enabling inputs to the Al portion include the "not collate" signal received over line 46 of cable 31 from control circuits 20 of document reproduction portion 10 and the line 36 signal from switch 48. The latter signal indicates sorting carriage 33 is in the home or upwardmost position as at 47. When all three signals are active, gate 27 can be activated in a synchronous relation to a document entering transport 11 at 12. In this regard, input sensing switch 50 supplies a document received signal over line 51 to complete the enablement of the Al input portion of AO 45. AO 45 then sets gate latch 52 to the active condition for supplying an enabling signal over line 53 to gate-actuating solenoid 54 to move gate 27 from the FIG. 1 illustrated downward position to the FIG. 2 illustrated upward position. Then documents traveling in portion 11, as indicated by arrow 55, instead of being deflected upwardly into noncollate document-receiving tray 13, continue on the document travel path indicated by dash line 56 toward collators 14 and 15. Travel path 56 is constructed using known techniques and is not further described for that reason. The documents traveling along path 56 finally reach gate 40 to be deflected downwardly into collator 14, as will be later described. Documents from path 56 deflected by gate 40 are carried by endless vacuumized belt 60 downwardly, as indicated by arrow 61. Irrespective of the vertical location of sorter carriage 33, indexing vane 62 on carriage 33 interecepts the document being transported by vacuum belt 60, deflecting it to move between a pair of driven rollers 66, thence into a selected one of the collator receiving bins, such as bin 67. The intermediate rollers 68 driven by belt 60 drive rollers 66 as long as belt 60 is rotated. Sorting carriage 33 moves vertically under control of downward path selector 23 when in the noncollate mode, in the collate mode sorting carriage is stepped differently.

As above mentioned, carriage 33 is in the upwardmost position closing switch 48 such that the documents passing by gate 40 are deflected into uppermost document receiving bin 32. In the noncollate mode, documents are supplied to bin 32 without indexing carriage 33 until counter 75 indicates that the appropriate number of documents have been inserted into bin 32. At this point, counter 75 supplies a signal via decode 75A over line 76 enabling AND circuit 73. When AND circuit 73 also is receiving the noncollate signal from line 46, it responds to the up/down counter 75 line 76 signals to index sorting carriage 33 to the next collator bin. In one constructed embodiment, up/down counter 75 actuates AND circuit 73 when the counter indicates that one more than the number of documents to be received by bin 32 (or any other bin) has passed entrance point 12. This indication resulted from switch 50 incrementing up/down counter 74 each time a document enters transport portion 11. When count decode 75A of counter 75 has detected that the number of documents in the output portion is one greater than the capacity of the document receiving bins 32, 34, etc., it supplies an enabling signal over line 76. Then, AND 73 sets index-down latch 74 to the active condition actuating a motor (not shown) operatively connected to sorter carriage 33, moving it downwardly one bin position in preparation for transporting the next group of received documents to bin 34, etc. Simultaneously, index-down latch 74 supplies its signal over line 76A through AO 77, via A2 input portion to reset up/down counter 75 to the reference state. This action prepares counter 75 for counting the number of documents to be entered into bin 34. The line 46 noncollate signal partially enables the A2 input portion.

When sorting carriage 33 has indexed down one position, it supplies a signal over line 37 resetting index-down latch 74. Bin 34 now can be filled with noncollate documents such that when it is filled, index down latch 74 is again set and the cycle repeated for each of the bins in collator 14.

When collator 14 is filled, gate 40 moves to the down position, deflecting documents from collator 14 into collator 15 which operates as above described for collator 14. Gate 40 moves under the control of multilatch 80, which is set to the active condition via the A2 input portion of A0 81. A bottom sensor 82 of collator 14 supplies an activated signal over line 83, which is combined by A2 input portion of 81 with the output signal of AND 73. This signifies that bin 35 is full and that carriage 33 is at the bottom of collator 14. Hence, collator 15 should now be used.

COLLATE MODE

Counter 75 in this mode also counts documents emitted by copier 10 at exit point 12. Sensing switch 50 supplies an indicating signal over line 51 to the A1 input portion of A0 circuit 90 which is partially enabled by a collate signal received from control 20. Gate 27 diverts the documents from noncollate tray 13 to travel along path 56. This is done initially via the A2 input portion of A0 45 setting gate latch 52. The A2 input portion responds to the collate signal on line 91 and to the excess latch 92 being reset to supply the latch 52 setting signal. As each document from path 56 enters collator 14, it is transported as above described, down vacuum belt 60 to sorting carriage 33.

Each time a document is inserted into one of the collator bins, such as 32, 34, carriage 33 is stepped downwardly one bin position. Index latch 74 supplies the carriage 33 stepping signal over line 76A. To generate the stepping signal in the collate mode, collate signal on line 91 partially enables AND circuit 93 to set index latch 74. Other inputs to AND circuits 93 are 1-to-20 count signal from decoder 75A, a document exit indication from vane 62 received over line 94 from a sensor 95 in carriage 33, and a number 1 collator attachment indicating signal received over line 96. The latter signal results from a collator 14 being connected to portion 10. Upon completion of indexing one bin position, collator 14 supplies an index complete signal over line 37, resetting latch 74 in preparation for the next collating step.

Upon reaching the bottom of collator 14, the direction of travel of the carriage is reversed by up/ down trigger 97. Trigger 97 is initially set to the down indicating position, i.e., carriage 33 is in its home position at the top of the collator. Upon reaching the bottom of collator 14, carriage 33 collates upwardly. To reverse the collating direction of travel, either the last copy signal received over line 98 from position 10 or the signal on line 83 from sensor 82 triggers up/down trigger 97 to the opposite state thereby reversing the direction of carriage 33 travel. The last-copy signal on line 98 is generated in portion 10 in the known manner; i.e., the number-of-copies register (not shown) is compared with a copy-generated counter (not shown) to indicate that the last copy of a run has been sent. The signal is suitably delayed to allow for transportion of the last copy from exit point 12 to vane switch 95 of carriage 33.

To reverse the direction of carriage 33 travel upon reaching home position at 48, AND circuit 105 responds to the home signal on line 36 and to the up/ down trigger 97, indicating an up direction to supply a trigger signal, triggering up/down counter 97 to the down position.

When the number of copies to be collated is greater than the number of document-receiving bins of collator 14, multi-latch 80 is set to active condition actuating gate 40 to the down position for deflecting documents from path 56 into collator 15 rather than into collator 14. Operation of collator 15 is identical to that described for collator 14 and includes circuits as above described; i.e., index latch 74 is repeated in collator 15. When the carriage in collator 15 corresponding to carriage 33 of collator 15 reaches the bottom, an up/-down trigger, such as trigger 97, for collator 15, is triggered to the opposite state. A last-copy signal on line 98 is also supplied to second collator 15 for performing the same function.

Whenever a last-copy signal is received over line 98, multi-latch 80 resets for returning gate 40 to the illustrated position. Multi-latch 80 is also reset via OR circuit 101. Whenever the copy count indicated on line 102 by counter 75 is decoded as being in the range 1-to-20 also resets multi-latch 80. Additionally, a bottom sensor in collator 15 such as sensor 82 of collator 14 can be used to reset multilatch 80.

The above-described operation in the collate mode occurs when the number of copies to be collated does not exceed the total number of document-receiving bins in both collators 14 and 15, and the number of copies to be collated does not exceed the document receiving capacity of the individual bins.

In the event that the collate request is for collating a number of pages greater than the number of document-receiving bins in both collators 14 and 15, the first number of copies equal to the number of document receiving bins is placed in the two collators, and excess numbers of copies are placed in the noncollate tray 13 as noncollated copies. To this end, excess latch 92 and gate latch 52 cooperated to deflect document gate 27 to the down position for deflecting documents into tray 13. The A2 input portion of A0 circuit 106 responds to the collate 2 signal on line 107 from control 20 indicating a second collator is attached and to the signal on line 108 indicating that the last document of the capacity of the two collators has been received at station 12 as indicated by counter 75 to set excess latch 92. Excess latch 92 being set partially enables the A2 input portion of A0 110 in preparation for resetting gate latch 52. The document entering signal on line 51 passes through the input portion of A0 110 resetting gate latch 52 which disables solenoid 54 allowing gate 27 to be spring-biased downwardly into a tray 13 document deflecting position. The documents residing in path 56 are still collated as above described, the subsequently received documents are transferred to tray 13. When portion 10 indicates a last copy excess latch 92 resets which enables the A2 input portion of A0 45 together with the collate signal on line 91, again setting latch 52 in preparation for receiving documents to be collated from portion 10.

When the number of pages to be collated (number of copy pages in a given set) is greater than the capacity of the individual bins, the apparatus is stopped requiring operator intervention for removing the copies collated up to the capacity of the bins. Then, the apparatus can be restarted to finish the collating operation. However, when the number of copies to be made of each page being collated (number of sets of copies) exceeds the number of document receiving bins in collators 14 and 15, the excess pages are inserted into noncollate tray 13.

In the event that only collator 14 is operatively connected to the document reproduction portion 10, the A1 input portion of A0 106 responds to the collate number 1 signal on line 96 and the collator bin capacity indicating signal on line 115 to set excess latch 92. Latch 92 being set sets gate latch 52 which operates in the afore-described manner. Excess latch 92 can also be reset by the A1 input portion of A0 111. Whenever decode 75A indicates an up/down count within the capacity of collator 14, an enabling signal supplied over line 102 is combined with the collate 1 signal on line 96 and a misfeed signal received over line 24 to reset excess latch 92. Additionally, the A2 input portion of A0 111 is responsive to the misfeed signal on line 24. Collate 2 signal on line 107, plus the indicating signal on line 116, indicates that the copy count is within the range of collator 15 to reset excess latch 92. This action enables recovery from a misfeed which is beyond the scope of the present description. However, in this regard, up/down counter 75 is decremented whenever a misfeed signal on line 24 enables same to be counted down. Such down counting recovers the count in the apparatus up to the point of jam, such that the appropriate number of copies or documents are produced by the apparatus.

While the invention has been particularly shown and described with reference to a preferred embodiment thereof, it will be understood by those skilled in the art that various changes in form and details may be made therein without departing from the spirit and scope of the invention.

What is claimed is:

1. Document reproduction apparatus for selectively making one or more individual duplicate documents from an original document, or for making a number of collated document sets of a multi-page original document, including in combination:

a copy tray adapted to receive said individual duplicate documents;

a first sensor cooperating with said tray and operable to detect the presence of a first given number of duplicate documents therein;

a second given number of collator bins, each said bin adapted to receive a third given number of duplicate documents;

second sensor means cooperating with said bins and operable to indicate the presence of said third given number of duplicate documents in one of said bins;

document deflector/conveyor means operable to selectively convey duplicate documents from a copier to said tray and to said bins, such that duplicate documents are sequentially deposited in the first to the Nth bin;

operator control means enabling selection of a copy or collate mode of operation;

automatic control means actuatable by said operator control means and constructed to facilitate a copy request for a number of noncollated copies greater than said first given number or a collate request for a number of collated sets greater than said second given number; and document path control means in said automatic control means responsive to said first and second sensor means, and having means operable to control said sheet deflector/conveyor means to route all noncollate duplicate documents to said tray when a copy request is less than said first given number; and to route said first given number of duplicate documents to said tray and thereafter route no more than said third given number of duplicate documents copies to each of said bins.

2. The document reproduction apparatus defined in claim 1 wherein said automatic control means further includes means in said document path control means to actuate said document conveyor means to:

route one collated set of duplicate documents to the requested number of collator bins when a collate request is less than said second given number and the number of pages of a multipage original is less than said third given number; and means to route a first received of said third given number of duplicate documents of an original document to a requested number of collator bins, in collated sequence, and the remaining duplicate documents uncollated to said copy tray.

3. The document reproduction apparatus defined in claim 2 wherein said automatic control means includes means operable to actuate said document/conveyor means to:

route one collated set of said third given number of duplicate documents to each of said N bins, and all documents thereafter in a set of said duplicate documents uncollated to said tray, and inhibiting further copying whenever either the tray has received said first given number of sheets or the 1st collator bin has received said third given number of sheets.

4. The document reproduction apparatus defined in claim 1 wherein:

said second sensing means includes a counter;

means sensing a copy transfer past a predetermined point to increment said counter;

decode means responsive to said counter to indicate said third given number; and bin sensing means in said second sensing means responsive to a predetermined actual fullness of copies in one of said bins to indicate said third given number.

5. The document reproduction apparatus set forth in claim 4 wherein said decode means indicates said third given number to a first count modulus less than the actual capacity of said collator bin.

* * * * *